United States Patent [19]

Kato

[11] Patent Number: 4,914,977

[45] Date of Patent: Apr. 10, 1990

[54] STROKE CONTROL DEVICE FOR USE IN PRESS

[75] Inventor: Heizaburo Kato, Shizuoka, Japan

[73] Assignee: Sankyo Manufacturing Company, Ltd., Tokyo, Japan

[21] Appl. No.: 291,164

[22] Filed: Dec. 28, 1988

[30] Foreign Application Priority Data

Dec. 29, 1987 [JP] Japan ..... 62-333165

[51] Int. Cl.[4] ..... G05G 1/00; B30B 5/00

[52] U.S. Cl. ..... 74/571 L; 74/603; 83/527; 83/530; 83/628; 100/257

[58] Field of Search ..... 100/257, 214, 282, 292; 74/571 M, 571 R, 571 L; 83/530, 527, 628

[56] References Cited

U.S. PATENT DOCUMENTS

| | | | |
|---|---|---|---|
| 1,774,245 | 8/1930 | Strout | 100/257 X |
| 1,788,071 | 1/1931 | Strout | 100/257 X |
| 2,310,209 | 2/1943 | Bousman | 74/571 L |
| 2,594,836 | 4/1952 | Wunderlich et al. | 74/571 L |
| 3,064,559 | 11/1962 | Treer | 100/292 |
| 3,600,957 | 8/1971 | Stoffel | 74/571 M X |
| 4,135,446 | 1/1979 | Bareis et al. | 83/530 X |

FOREIGN PATENT DOCUMENTS 51-12150 4/1976 Japan .

*Primary Examiner*—Harvey C. Hornsby
*Assistant Examiner*—Stephen F. Gerrity
*Attorney, Agent, or Firm*—Pollock, Vande Sande & Priddy

[57] ABSTRACT

A stroke control has an eccentric member fitting on an eccentric member mounting portion of a drive shaft and the eccentric member is at an eccentricity with respect to the drive shaft and has sliding surfaces which are in sliding engagement with the eccentric mounting portion. A connecting rod rotatably carried by the outer peripheral surface of the eccentric member and swingably connected to the slide. A gear shaft extends through the eccentric member mounting portion and has spline-type gear teeth on end portions thereof, the gear shaft being rotatably supported by the eccentric member. A plurality of screw rods are arranged in parallel with the gear shaft such as to extend through the eccentric member mounting portion, the screw rods being fixed to the eccentric member. Gears screwed to the screw rods and meshing with the spline type gear teeth on the gear shaft, the gears contacting the eccentric member mounting portion.

1 Claim, 2 Drawing Sheets

STROKE CONTROL DEVICE FOR USE IN PRESS

BACKGROUND OF THE INVENTION

The present invention relates to the device for controlling the stroke length of a slide in a press.

A stroke control device for a press has been known which incorporates, as disclosed in Japanese Patent Examined Publication No. 51-12150 (see related U.S. Pat. No. 3,765,266), a pair of eccentric members. More specifically, this stroke control device has an eccentric shaft portion on a drive shaft, and an eccentric sleeve rotatably mounted on the outer surface of the eccentric shaft portion for a rotation relative thereto, the eccentric sleeve having outer peripheral surface centered at a point which is at an eccentricity from the axis of the eccentric shaft portion. The stroke control device further has a connecting rod the upper end of which rotatably fits around the eccentric sleeve, while the lower end of the connecting rod is connected to a slide of a press. In operation, the eccentric shaft portion is rotated relative to the eccentric sleeve so as to vary the amount of eccentricity and, hence, the stroke length of the slide. The stroke control device further incorporates a releasable locking mechanism which, when the press which drives the rotary shaft operates, locks the eccentric shaft portion and the eccentric sleeve against relative rotation, whereas, when the eccentricity is to be varied, unlocks them from each other so as to allow a relative rotation therebetween.

This known stroke control device, however, suffers from a disadvantages in that the construction is inevitably complicated due to the use of the releasable locking mechanism. Another problem encountered with this known stroke control device is that, since the transmission of the torque from the eccentric shaft portion to the eccentric sleeve is conducted indirectly through the above-mentioned locking mechanism, the rigidity of the path of torque transmission is undesirably reduced to impair the precision in the torque transmission. Still another problem is that the eccentricity cannot be varied linearly due to the fact that the locking mechanism which locks the eccentric shaft portion and the eccentric sleeve against relative rotation is designed to change the locking position non-linearly, i.e., in a stepped manner.

SUMMARY OF THE INVENTION

Accordingly, an object of the present invention is to provide a stroke control device which is capable of overcoming the above-described problems of the prior art.

To this end, according to the present invention, there is provided a stroke control device comprising: a drive shaft adapted to be rotatingly driven and having an eccentric member mounting portion; an eccentric member fitting on the eccentric member mounting portion, the eccentric member having an outer peripheral surface which is at an eccentricity with respect to the drive shaft and sliding surfaces which are in vertical sliding engagement with both side surfaces of the eccentric mounting portion; a connecting rod having an upper end portion rotatably carried by the outer peripheral surface of the eccentric member and a lower end portion swingably connected to a slide; a gear shaft vertically extending through the eccentric member mounting portion and provided with spline-type gear teeth on upper and lower end portions thereof, the gear shaft being rotatably supported at its upper and lower ends thereof by the eccentric member; a plurality of screw rods arranged on both sides of the gear shaft such as to extend in parallel with the gear shaft through the eccentric member mounting portion, the screw rods being fixed at their upper and lower ends to the eccentric member; and gears screwed to upper and lower end portions of the screw rods and meshing with the spline type gear teeth on the upper and lower end portions of the gear shaft, the gears contacting upper and lower end surfaces of the eccentric member mounting portion; whereby, when the gear shaft is rotated, the gears rotate to cause the screw rods to move up and down relative to the drive shaft together with the gear shaft and the eccentric member so as to cause a change in the amount of eccentricity of the eccentric member with respect to the drive shaft, thereby allowing a control of the length of stroke of the slide.

In operation, as the gear shaft is rotated while the drive shaft is fixed, the gear rotates without moving vertically so that the screw rod engaging with the gear is caused to move up and down, with the result that the eccentric member also moves up and down together with the screw rod. In consequence, the amount eccentricity of the eccentric member with respect to the drive shaft is changed to enable the stroke length of the slide to be controlled.

The above and other objects, features and advantages of the present invention will become clear from the following description when the same is read in conjunction with the accompanying drawings.

DESCRIPTION OF THE PREFERRED EMBODIMENT

Figure 1:
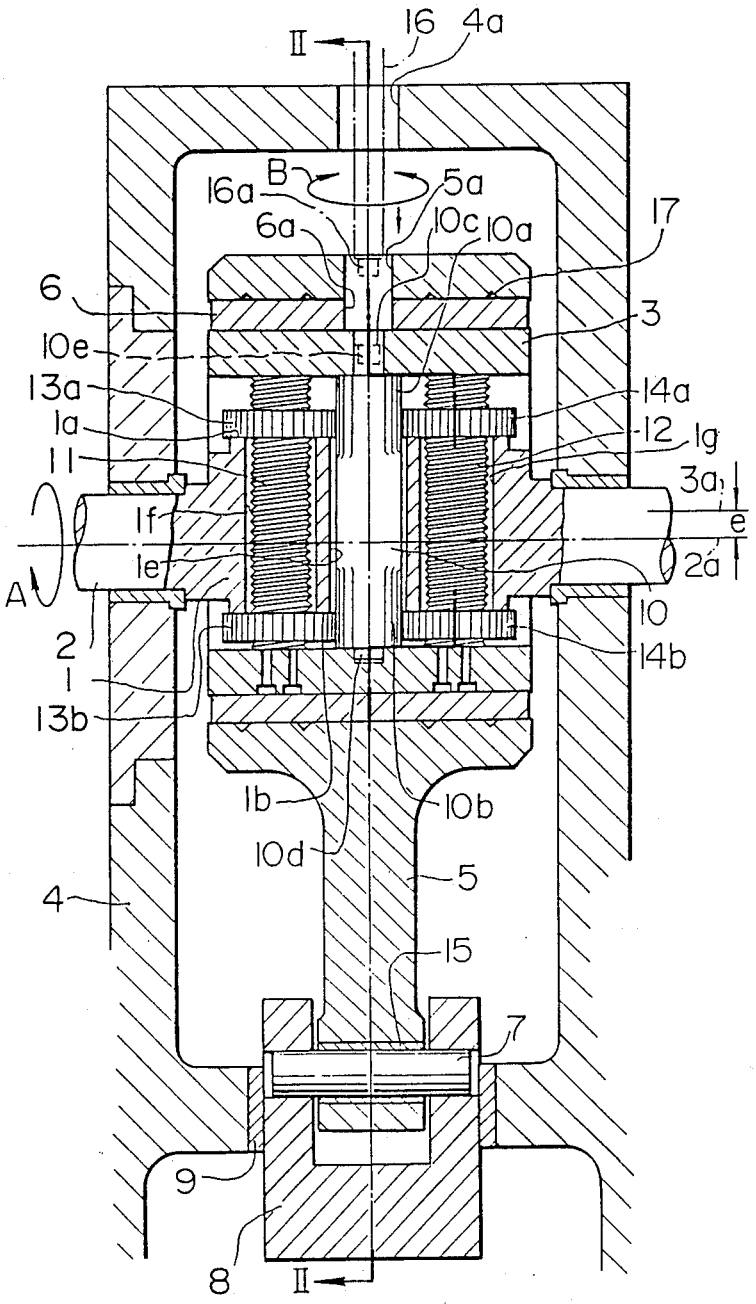
FIG. 1 is a vertical sectional view of a press incorporating a stroke control device embodying the present invention.
Figure 2:
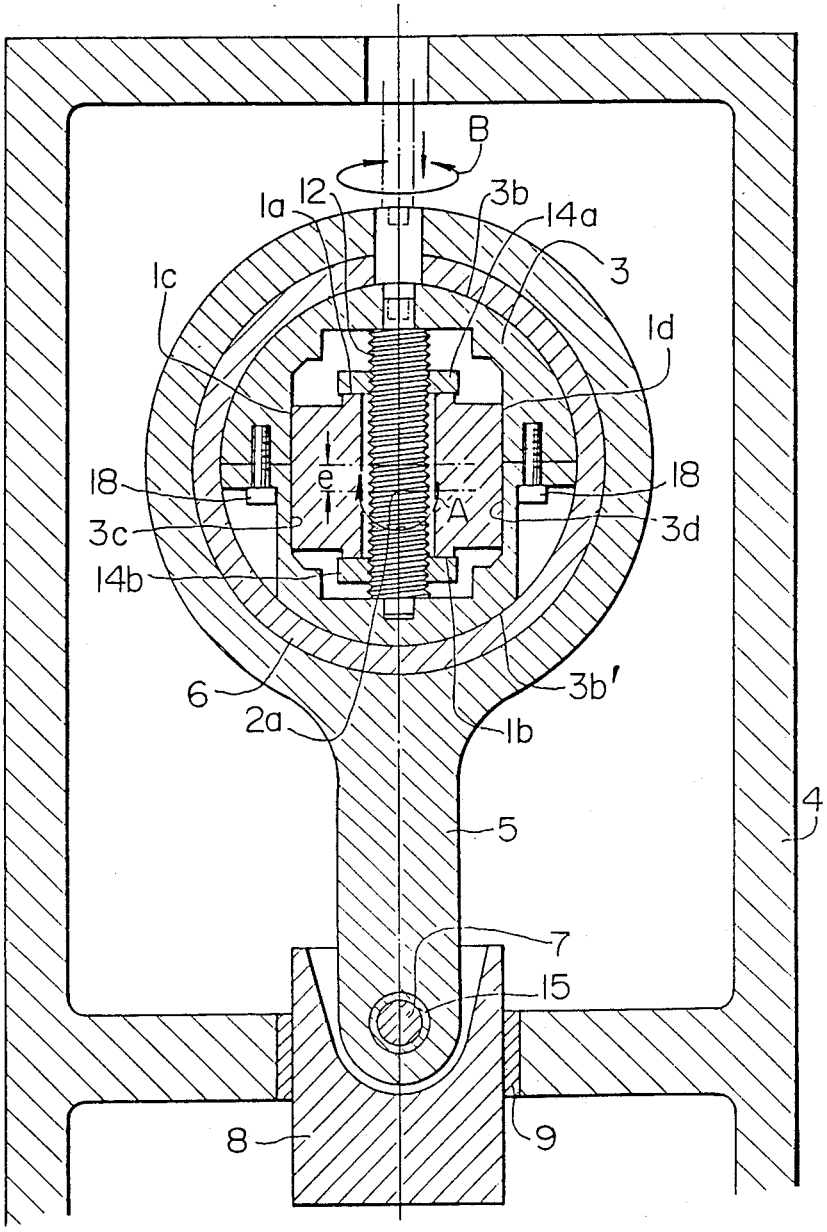
FIG. 2 is a sectional view taken along the line II—II of FIG. 1.

Referring to FIGS. 1 and 2, there is shown a press incorporating a stroke control device in accordance with the present invention. The stroke control device has a drive shaft 2 which is rotatably carried by a housing 4 and provided with an eccentric member mounting portion 1. The stroke control device also has an eccentric member 3 which fits around the eccentric member mounting portion 1 and which has outer peripheral surfaces 3*b*, 3*b*, located on a circle centered at an axis 3*a* which is at an eccentricity e from the axis 2*a* of the drive shaft 2. The eccentric member mounting portion 1 has flat parallel upper and lower end surfaces 1*a* and 1*b*, as well as flat and parallel side surfaces 1*c* and 1*d*, thus exhibiting a substantially rectangular cross-section. The side surfaces 1*c* and 1*d* of the eccentric member mounting portion 1 slidingly engage with inner surfaces 3*c* and 3*d* of the eccentric member 1. The stroke control device further has a connecting rod 5 the upper end of which is held on the eccentric member 3 through a sleeve-type slide bearing 6 such that the upper end of the connecting rod 5 is rotatable relative to the eccentric member 3. The lower end of the connecting rod 5 is rotatably connected to the slide 8 of a press through a pin 7 and a slide bearing 15. The slide 8 is vertically movably carried by the housing 4 through a slide bearing 9.

Through holes 1e, 1f and 1g are formed substantially at axially mid portion of the eccentric member mounting portion 1 and on the left and right side of the mid portion as viewed in FIG. 1, in such a manner as to extend vertically through the eccentric member mounting portion 1. These through holes 1e, 1f and 1g receive, respectively, a gear shaft 10, a screw rod 11 and another screw rod 12 which extend in parallel with one another. Spline-type gear teeth 10a and 10b are formed on upper and lower portions of the gear shaft 10. The gear shaft 3 is rotatably supported at its upper and lower ends by the eccentric member 3. A recess 10e of a non-circular cross-section is formed on the end surface of the upper end 10c of the screw shaft 10 so as to be engaged by a suitable tool 16 which can be inserted to reach this recess 10e through continuous holes 4a, 5a and 6a formed in the wall of the housing 4, connecting rod 5 and the slide bearing 6. The screw rods 11 and 12 are fixed to the eccentric member 3 at their upper and lower ends. Gears 13a, 14a and gears 13b, 14b are screwed to upper and lower portions of the screw rods 11 and 12. The upper gears 13a, 14a and lower gears 13b, 14b mesh with the upper and lower gear teeth 10a and 10b. The lower end surfaces 13a, 14a of the gear 13a contact the upper end surface 1a of the eccentric member mounting portion 1, while the upper end surfaces of the gears 13b, 14b contact the lower end surface 1b of the eccentric member mounting portion 1b.

As will be understood from FIG. 2, the eccentric member 3 is composed of two parts: namely, an upper part presenting the outer peripheral surface 3b and a lower part presenting the outer peripheral surface 3b'. The upper and lower parts are assembled together around the eccentric member mounting portion 1 and fastened to each other by means of bolts 18. In FIG. 1, a reference numeral 17 denotes an oil groove.

In operation, as the drive shaft 2 rotates about its axis 2a as indicated by an arrow A, the eccentric member 3 also rotates about the axis 2a as a unit with the drive shaft 2, so that the upper end of the connecting rod 5 moves up and down while being allowed to rotate relative to the eccentric member 3 by virtue of the provision of the slide bearing 6. In consequence, the slide 8 also moves up and down in accordance with the movement of the connecting rod 5. In consequence, a press work is effected on a material which is placed between a lower die disposed under the slide 8 and an upper die which is secured to the underside of the slide 8. The length of stroke of the sliding motion of the slide is twice as large the above-mentioned eccentricity e.

When it is desired to change the length of stroke of the slide 8, the operator inserts a tool 16 through the holes 4a, 5a and 6a to bring the end 16a of the tool 16 into engagement with the recess 10e in the end surface of the gear shaft 10 nd rotates the gear shaft 10 as indicated by an arrow B while fixing the drive shaft 2 against rotation. The rotation of the gear shaft 10 causes the gears 13a, 13b, 14a and 14b to rotate so that the screw rods 11 and 12 meshing with these gears are moved up and down so that the gear shaft 10 and the eccentric member 3 are moved up and down together with the screw rods. As a result, the amount e of eccentricity of the eccentric member 3 is changed with respect to the drive shaft 2, thus effecting a control of the length of stroke of the slide 8.

As will be understood from the foregoing description, in the stroke control device of the present invention, the transmission of the torque from the drive shaft to the eccentric member is made directly through the engagement between both side surfaces of the eccentric member mounting portion of the drive shaft and the sliding surfaces of the eccentric member. In consequence, the construction of the eccentricity control device is simplified and the rigidity of the path of transmission of the torque is increased to enhance the precision of transmission of the torque. In addition, the stroke of the slide can be controlled linearly simply by rotating the gear shaft. Furthermore, the amount of eccentricity, i.e., the stroke of the slide, can be indicated in terms of angle or amount of rotation of the gear shaft with the aid of a suitable gradation, because the eccentricity e varies in proportion to the angle or amount of rotation of the gear shaft.

What is claimed is:

1. A stroke control device comprising:

a drive shaft adapted to be rotatingly driven and having an eccentric member mounting portion;

an eccentric member fitting on said eccentric member mounting portion, said eccentric member having an outer peripheral surface which is at an eccentricity with respect to said drive shaft and sliding surfaces which are in vertical sliding engagement with both side surfaces of said eccentric mounting portion;

a connecting rod having an upper end portion rotatably carried by the outer peripheral surface of said eccentric member and a lower end portion swingably connected to a slide;

a gear shaft vertically extending through said eccentric member mounting portion and provided with spline-type gear teeth on upper and lower end portions thereof, said gear shaft being rotatably supported at its upper and lower ends thereof by said eccentric member;

a plurality of screw rods arranged on both sides of said gear shaft such as to extend in parallel with said gear shaft through said eccentric member mounting portion, said screw rods being fixed at their upper and lower ends to said eccentric member; and gears screwed to upper and lower end portions of said screw rods and meshing with said spline type gear teeth on the upper and lower end portions of said gear shaft, said gears contacting upper and lower end surfaces of said eccentric member mounting portion;

whereby, when said gear shaft is rotated, said gears rotate to cause said screw rods to move up and down relative to said drive shaft together with said gear shaft and said eccentric member so as to cause a change in the amount of eccentricity of said eccentric member with respect to said drive shaft, thereby allowing a control of the length of stroke of said slide.

* * * * *